US010450133B2

(12) United States Patent
Chen

(10) Patent No.: US 10,450,133 B2
(45) Date of Patent: Oct. 22, 2019

(54) GARBAGE CAN

(71) Applicant: Huizhen Chen, Yongkang (CN)

(72) Inventor: Huizhen Chen, Yongkang (CN)

( * ) Notice: Subject to any disclaimer, the term of this patent is extended or adjusted under 35 U.S.C. 154(b) by 476 days.

(21) Appl. No.: 15/251,024

(22) Filed: Aug. 30, 2016

(65) Prior Publication Data

US 2017/0334641 A1 Nov. 23, 2017

(30) Foreign Application Priority Data

May 17, 2016 (CN) ..... 2016 1 0351760
May 17, 2016 (CN) ..... 2016 2 0468892 U

(51) Int. Cl.
*B65F 1/06* (2006.01)
*B65F 1/16* (2006.01)

(52) U.S. Cl.
CPC ..... *B65F 1/062* (2013.01); *B65F 1/068* (2013.01); *B65F 1/163* (2013.01); *B65F 2210/126* (2013.01); *B65F 2210/148* (2013.01)

(58) Field of Classification Search
CPC ..... B65D 21/0202; B65D 21/0201; B65D 21/0204; B65D 21/02; B65D 21/06; B65D 21/0224; B65D 21/0233; B65D 1/36; B65D 1/34; B65D 7/08; B65D 7/06; B65D 7/02; B65D 25/2802; B65D 25/28; A47G 23/0633; A47G 23/06
USPC ..... 220/556, 555, 23.86, 23.83, 23.6, 23.2, 220/495.05, 495.09, 263, 264, 827, 908.1; 206/518, 519, 516, 515, 510, 509, 507, 206/504
See application file for complete search history.

(56) References Cited

U.S. PATENT DOCUMENTS 5,799,909 A * 9/1998 Ziegler ..... B65F 1/1415 220/481
6,126,031 A * 10/2000 Reason ..... B65F 1/062 220/495.04
6,283,321 B1 * 9/2001 Meshorer ..... B65F 1/06 220/4.22
6,345,725 B1 * 2/2002 Lin ..... B65F 1/1607 220/263
6,851,251 B2 * 2/2005 Stravitz ..... B09B 3/0025 53/370
D567,466 S 4/2008 Lee
7,427,086 B2 * 9/2008 Park ..... D06F 39/14 292/121
7,958,704 B2 * 6/2011 Stravitz ..... B65B 9/15 206/303
7,992,742 B1 8/2011 Kim
(Continued)

FOREIGN PATENT DOCUMENTS

CN 202449478 * 9/2012 ..... B65F 1/06

OTHER PUBLICATIONS

Translation of CN202449478(U), Zhang Zhilian, Sep. 26, 2012.*

*Primary Examiner* — Anthony D Stashick
*Assistant Examiner* — Onekki P Jolly
(74) *Attorney, Agent, or Firm* — Brett A. Schenck

(57) ABSTRACT

A trash can includes a can body, a trash bag being in use and arranged in the can body, a trash inlet formed in the upper part of the can body, an upper cover for sealing or opening the trash inlet, a support frame being arranged in the can body and including a through hole, and spare trash bags being continuously stacked and then sleeving the outer side of the support frame.

15 Claims, 7 Drawing Sheets

(56) References Cited

U.S. PATENT DOCUMENTS

| | | | | |
|---|---|---|---|---|
| 8,569,980 | B2 * | 10/2013 | Yang | B65F 1/1638 220/200 |
| 8,646,384 | B1 * | 2/2014 | Moglia | B30B 9/3021 100/100 |
| 8,678,219 | B1 * | 3/2014 | Wang | B65F 1/163 220/211 |
| 9,718,614 | B2 * | 8/2017 | Chomik | B65B 7/12 |
| 9,850,064 | B2 * | 12/2017 | Egan | B65F 1/062 |
| 2003/0230579 | A1 * | 12/2003 | Chomik | A47K 11/02 220/495.1 |
| 2005/0224496 | A1 * | 10/2005 | Moyer | B65F 1/06 220/264 |
| 2006/0283862 | A1 * | 12/2006 | Yang | B65F 1/068 220/495.06 |
| 2009/0039081 | A1 * | 2/2009 | Fort | B65F 1/06 220/23.87 |
| 2009/0194532 | A1 * | 8/2009 | Yang | B65F 1/1638 220/211 |
| 2010/0147865 | A1 * | 6/2010 | Yang | B65F 1/04 220/810 |
| 2011/0220654 | A1 * | 9/2011 | Gray | B65F 1/062 220/495.06 |
| 2013/0048641 | A1 * | 2/2013 | Romano | B65F 1/06 220/495.08 |
| 2014/0246439 | A1 * | 9/2014 | Friedman | B65F 1/06 220/495.11 |
| 2015/0068155 | A1 * | 3/2015 | Chomik | B65B 7/12 53/370 |

* cited by examiner

GARBAGE CAN

BACKGROUND OF THE INVENTION

1. Field of the Invention

The present invention relates to a trash can.

2. Description of the Related Art

At present, there are various trash can structures in the art. For example, Chinese patent No. CN201120017941.8 discloses a "convenient trash can" which comprises a horizontal partition plate proximate to the bottom part of the trash can, a long slot formed in the middle of the partition plate at a lower part of the convenient trash can, a plastic trash bag roll placed below the long slot. The outmost trash bag of the trash bag roll passes through the middle part of the long slot in the middle of the partition plate and opens at an upper opening. The edge of the upper opening is turned back outwards and sleeves the edge of the upper opening of a can body. A collar clamped on the edge of the upper opening is arranged in the upper opening of the can body, and the collar is arranged outside the trash bag which sleeves the edge of the upper opening of the can body. The whole roll of trash bags are put into the trash can in advance and are used one by one, so that the trash can is simple in structure and convenient to be used. However, the trash can has the following shortcomings: because the trash bags of the trash cans are arranged at the bottom part of the can body, when one trash bag is damaged, trashes and sewage easily pollute a spare trash bag to cause waste of the trash bags. Meanwhile, the sleeving operation of the trash bag as discussed above is also very inconvenient.

SUMMARY OF THE INVENTION

One objective of the present invention is to provide a trash can which facilitates reliably storing spare trash bags in the trash can, preventing trashes and sewage from polluting the spare trash bags, and conveniently replacing the trash bag in use.

The trash can in accordance with an embodiment of the present application comprises a trash bag arranged in a can body of the trash can, a trash inlet formed in the upper part of the can body, an upper cover for sealing or opening the trash inlet, and a support frame arranged in the can body of the trash can. The trash bag is an elongated tubular trash bag. Spare trash bags are continuously stacked and then sleeve the outer side of the support frame. A trash bag in use passes through a through hole in the support frame and is arranged at the inner side of the support frame. The support frame keeps an opening part of the trash bag open. The bottom part of the trash bag is sealed in a knotting manner. When the trash bag is pulled, the elongated tubular trash bag is pulled out from the through hole in the support frame. The can body of the trash can comprises an upper-section can body and a lower-section can body. The support frame is located in the upper-section can body. The lower-section can body is provided with a door, which can be opened in a rotating manner, and a cutter for cutting the trash bag at the inner side of the door body.

The trash can in accordance with the present invention has the following advantages: 1) the spare trash bags are continuously stacked and then sleeve the outer side of the support frame so that the trash bags can be stored into the trash can; 2) the trash bag in use is located at the inner side of the support frame and can prevent the trashes from polluting the support frame; 3) because the support frame is located in the upper-section can body, the trash bag in use passes through the through hole in the support frame and is arranged at the inner side of the support frame, the spare trash bags are continuously stacked and then sleeve the outer side of the support frame, the spare trash bags are not polluted in case the trash bag of the trash can in use is damaged; 4) the support frame keeps the opening part of the trash bag open, the bottom part of the trash bag is sealed in a knotting manner, and the elongated tubular trash bag is pulled out from the through hole in the support frame when the trash bag is pulled, so that the operation of replacing the trash bag is very convenient; 5) the lower-section can body is provided with a door body which can be opened in a rotating manner, and the cutter for cutting the trash bag is arranged at the inner side of the door body, so that the trash bag is full of the trashes and the door body is opened, the elongated tubular trash bag is cut off by the cutter, and the trashes can be conveniently taken out; 6) the operation of replacing the trash bag is quickly completed after a trash bag is pulled out and its bottom part is knotted.

According to an embodiment of the present application, a pedal is arranged in the trash can for driving the upper cover to open or close through a connecting rod. Thorough this structure, the upper cover can be conveniently opened through the pedal. In the alternative, the trash can may also adopt a pedal-free structure.

According to another embodiment of the present application, an outward folded edge is arranged at the lower part of the support frame for facilitating sleeving and locating of the spare trash bags and preventing the trash bag and the spare trash bags from sliding off.

As an embodiment, an elastic cushion ring which is matched with the lower part of the support frame is arranged in the trash can. The elastic cushion ring has a buffer effect when the trash bag is pulled, and prevents the trash bag from being damaged when the trash bag is pulled.

According to yet another embodiment, the opening part of the upper-section can body is provided with a locating snap ring which comprises a locating and clamping block, and a locating hole matched with the locating and clamping block is formed in the upper-section can body.

According to a further embodiment of the present application, an inner cover is arranged in the locating snap ring, an inner cover spring compels the inner cover to seal the trash inlet, and the inner cover can further seal the trash bag and prevent an odor from leaking. In the alternative, the trash can may also adopt an inner cover-free structure.

A locking knob for locking the inner cover may be arranged in the locating snap ring, and the inner cover may be locked or arranged at a depressible position by rotating the locking knob. The trash can may also adopt a locking knob-free structure.

The trash can may be provided with a base, and the lower-section can body may be fixed on the base so that the structure is beneficial to manufacturing of the trash can.

The upper and lower rotating shafts of the door body may respectively be located on the lower part of the upper-section can body and the base. A locking mechanism matched with the side wall of the door body may be arranged on the side surface of the lower-section can body, and the door body may be conveniently opened or closed by operating the locking mechanism.

The locking mechanism comprises clamping holes and clamping hooks. The clamping holes are formed in the side wall of the door body. The clamping hooks are arranged on the side surface of the lower-section can body. A pressing slope is arranged at the front end of each clamping hook. When the pressing slope at the front end of each clamping hook is in contact with the corresponding clamping hole, the clamping hook moves and enters the corresponding clamping hole. Each clamping hook is provided with a key which is exposed outside the outer surface of the lower-section can body, and each clamping hook can move and exit from the corresponding clamping hole by pressing the corresponding key to open the door body.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PRESENTLY PREFERRED EMBODIMENTS

Figure 1:
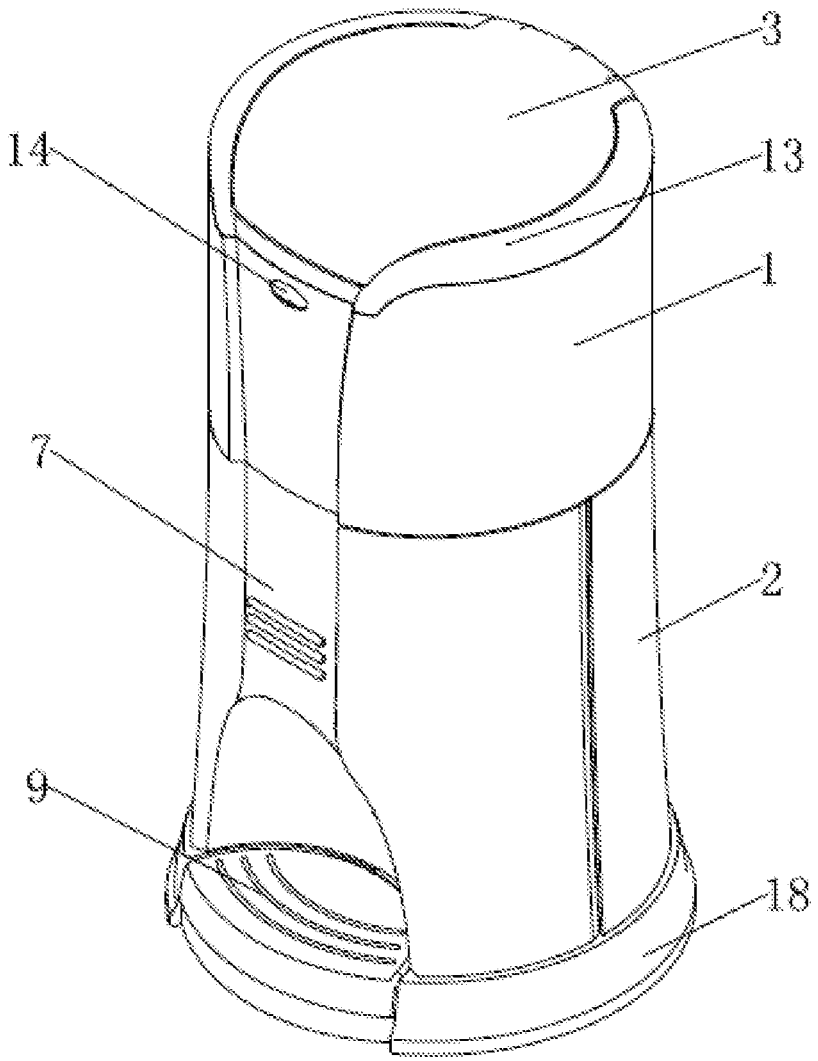
FIG. 1 is a perspective view of the trash can in accordance with an embodiment of the present application.
Figure 2:
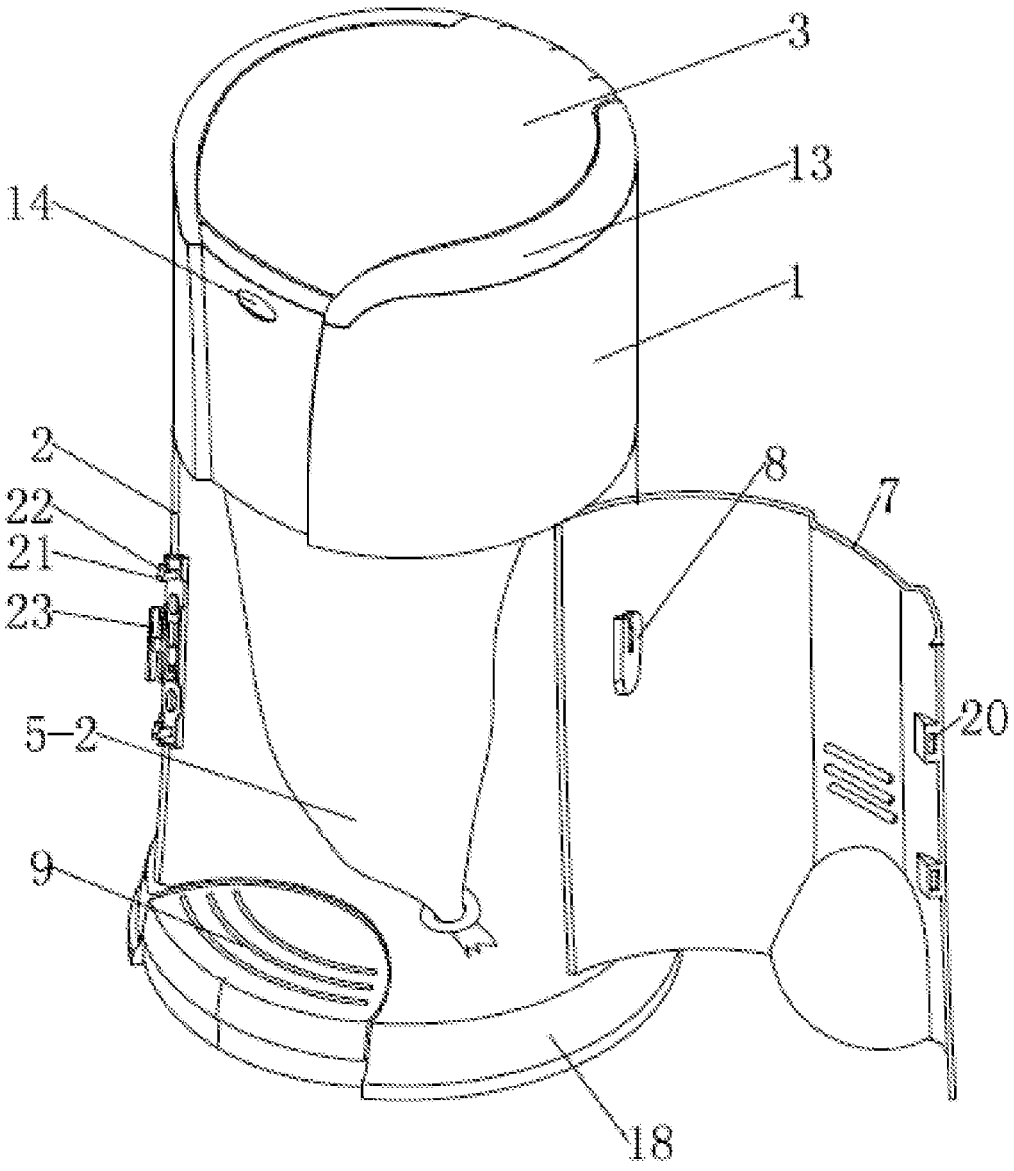
FIG. 2 is a diagrammatic drawing when the door body of the trash can is opened.
Figure 3:
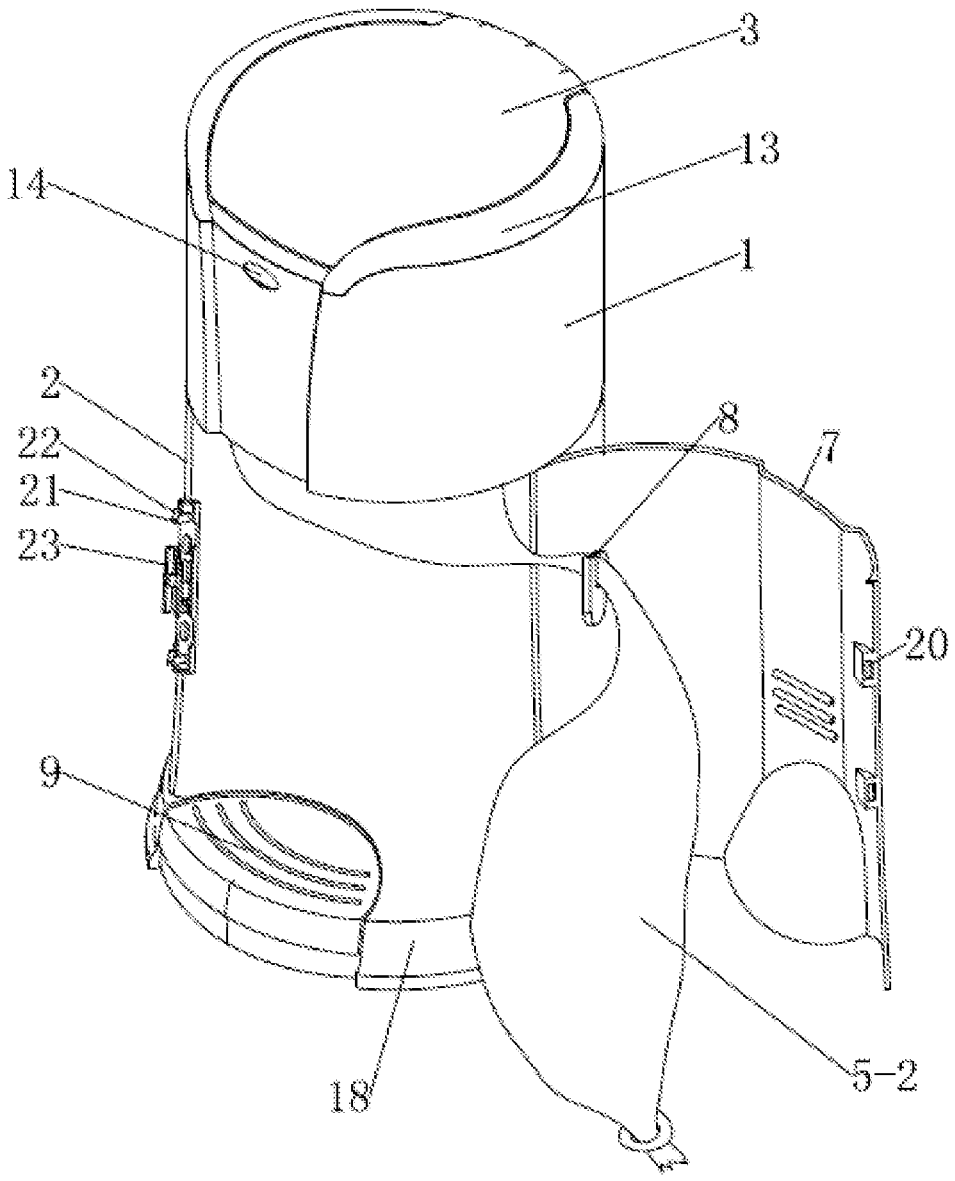
FIG. 3 is a diagrammatic drawing when the cutter cuts the trash bag when the door body of the trash can is opened.
Figure 4:
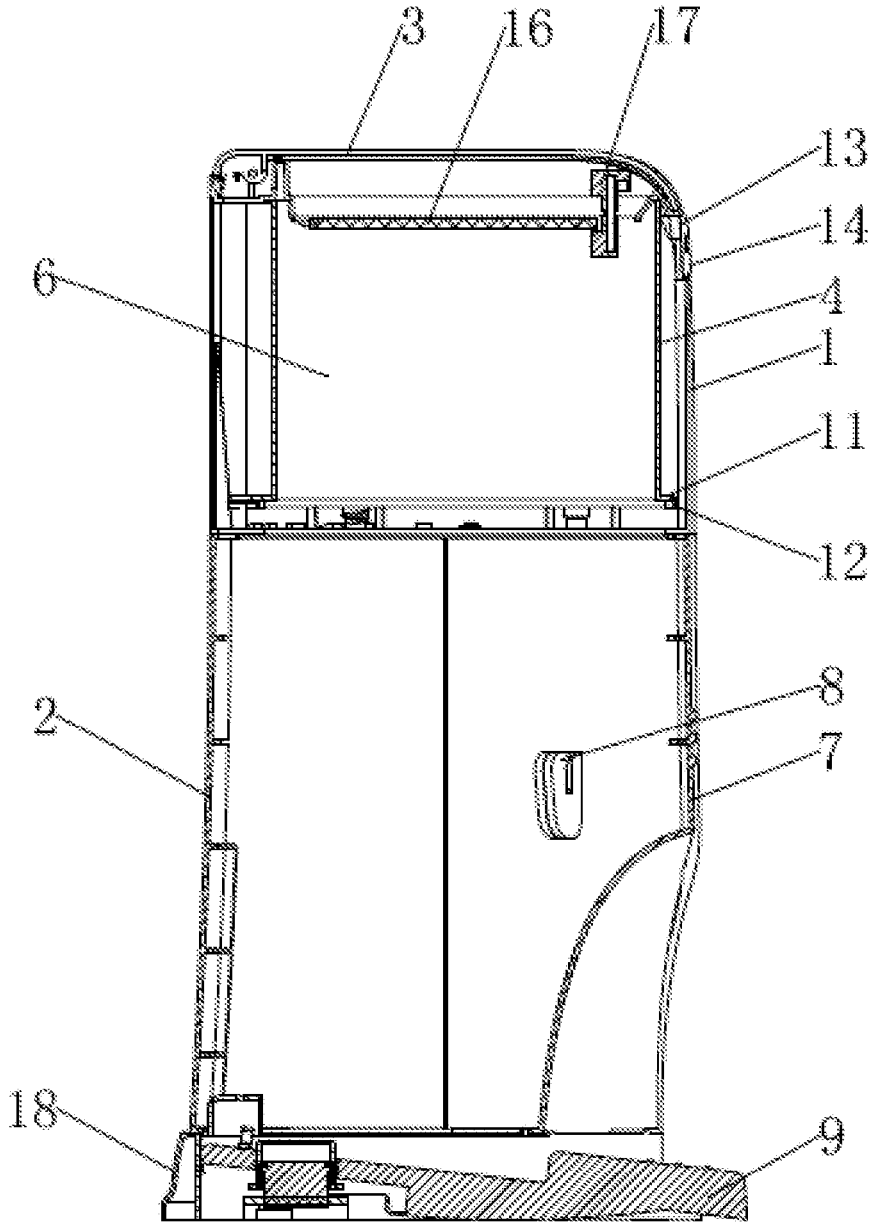
FIG. 4 is the cross-section illustrative view (the trash bag and the connecting rod are not shown in the view) of the trash can in accordance with an embodiment of the present application.
Figure 5:
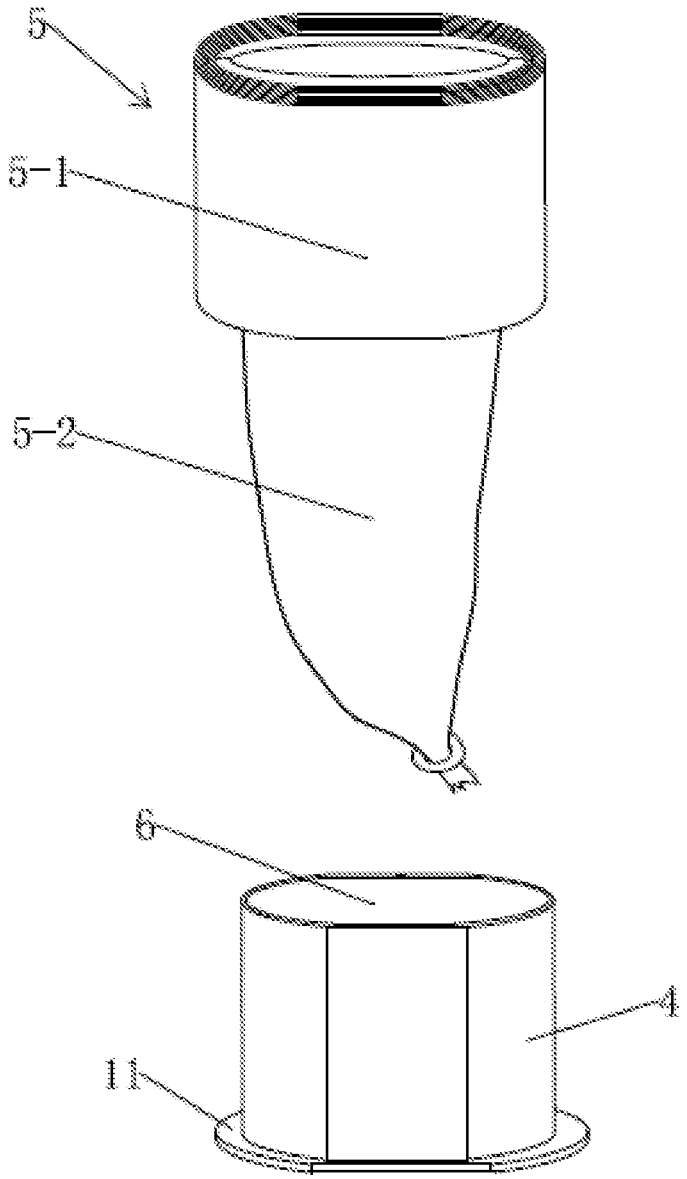
FIG. 5 is a perspective view of the trash can when the support frame is separated from the trash bag.
Figure 6:
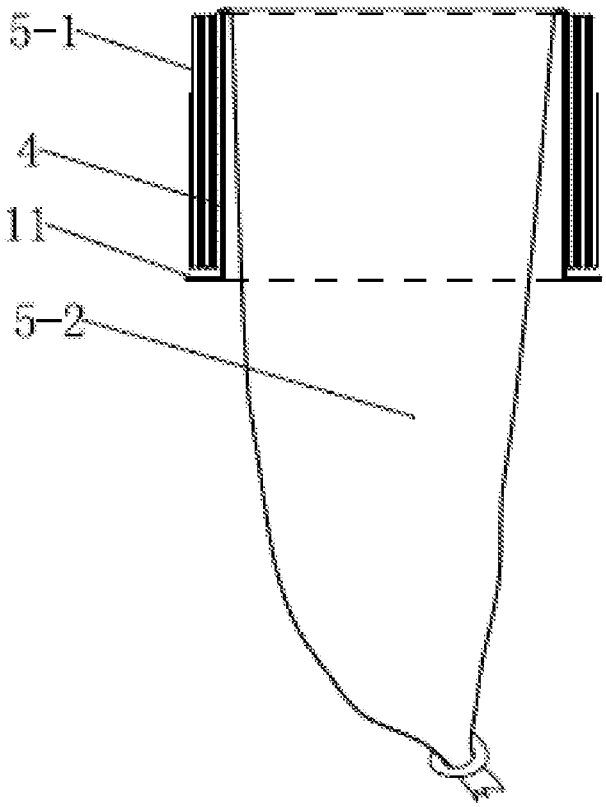
FIG. 6 is the cross-section illustrative view when the support frame and the trash bag are installed.
Figure 7:
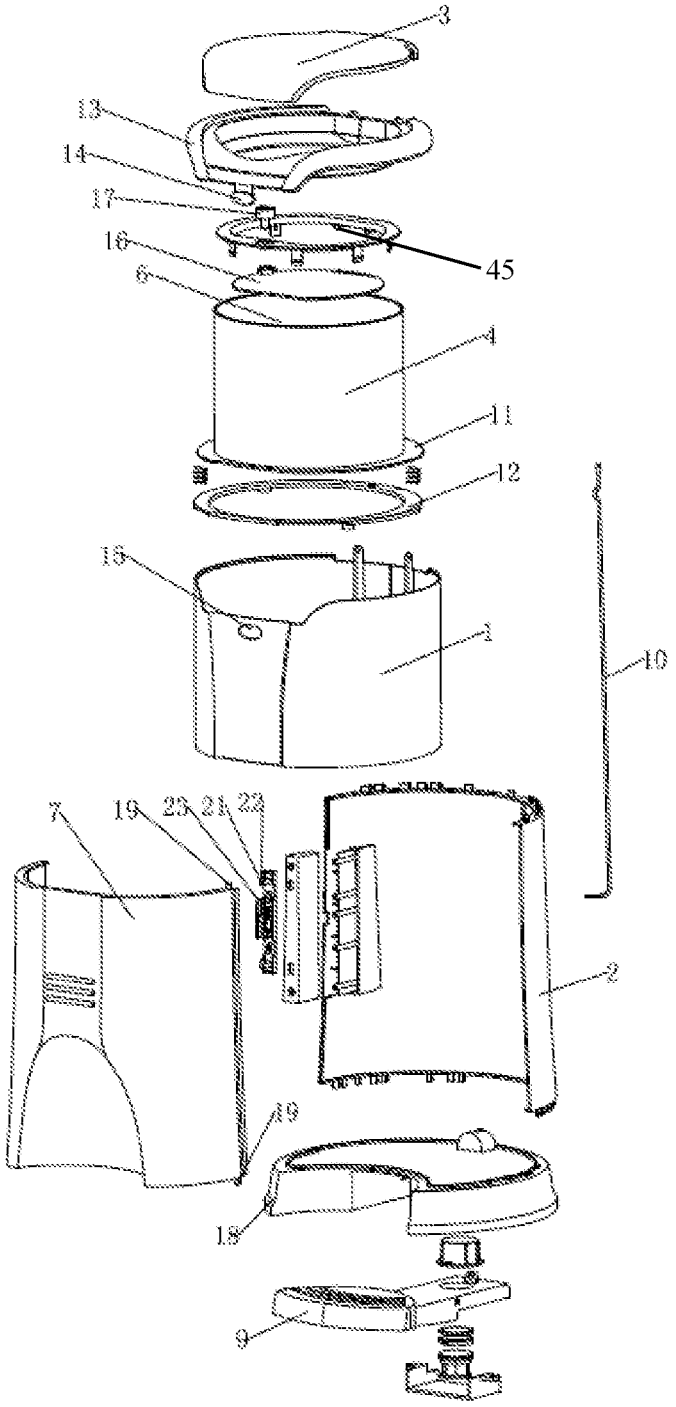
FIG. 7 is the exploded view (the trash bag is not shown in the view) of the components of the trash can.

As shown in FIGS. 1 to 7, according to an embodiment of the present application, the trash can comprises a trash bag arranged in a can body which comprises an upper-section can body 1 and a lower-section can body 2, a trash inlet formed in the upper part of the can body, an upper cover 3 can for sealing or opening the trash inlet, and a support frame 4 arranged in the can body. The trash bag 5 is an elongated tubular trash bag, spare trash bags 5-1 are continuously stacked and then sleeve the outer side of the support frame 4. A trash bag 5-2 in use passes through a through hole in the support frame and is arranged at the inner side of the support frame. The support frame keeps an opening part of the trash bag open. The trash bag seals the bottom part of the trash bag in a knotting manner. When the trash bag is pulled, the elongate tubular trash bag 5 is pulled out from the through hole 6 in the support frame 4. The support frame 4 is located in the upper-section can body 1. The lower-section can body 2 is provided with a door body 7 which can be opened in a rotating manner, and a cutter 8 for cutting the trash bag is arranged at the inner side of the door body.

In accordance with an embodiment, a pedal 9 is arranged in the trash can and drives the upper cover 3 to open or close through a connecting rod 10. The upper cover can be conveniently opened through the pedal by the structure.

In accordance with another embodiment, an outward folded edge 11 is arranged at the lower part of the support frame 4, and is beneficial to sleeving of the spare trash bags. An elastic cushion ring 12 which is matched with the lower part of the support frame is arranged in the trash can. The elastic cushion ring has a buffer effect when the trash bag is pulled, and prevents the trash bag from being damaged when the trash bag is pulled. The opening part of the upper-section can body is provided with a locating snap ring 13. A locating and clamping block 14 is arranged in the locating snap ring, and a locating hole 15 matched with the locating and clamping block is formed in the upper-section can body.

As an embodiment, an inner cover 16 is arranged in the locating snap ring 13, an inner cover spring 45 (FIG. 7) compels the inner cover 16 to seal the trash inlet, and a locking knob 17 for locking the inner cover is arranged in the locating snap ring. The inner cover 16 can be locked or arranged at the depressible position by rotating the locking knob 17, and the inner cover can further seal the trash bag and prevent an odor from leaking.

As an embodiment, the trash can is provided with a base 18, the lower-section can body 2 is fixed on the base, upper and lower rotating shafts 19 of the door body are located on the lower part of the upper-section can body and the base respectively, a locking mechanism matched with the side wall of the door body is arranged on the side surface of the lower-section can body, and the door body can be conveniently opened or closed by operating the locking mechanism.

According to yet another embodiment, the locking mechanism comprises clamping holes 20 and clamping hooks 21, wherein the clamping holes 20 are formed in the side wall of the door body 7; the clamping hooks 21 are arranged on the side surface of the lower-section can body; a pressing slope 22 is arranged at the front end of each clamping hook; when the pressing slope at the front end of each clamping hook is in contact with the corresponding clamping hole, the clamping hook moves and enters the corresponding clamping hole; each clamping hook is provided with a key 23 which is exposed outside the outer surface of the lower-section can body; and each clamping hook can move and exit from the corresponding clamping hole by pressing the corresponding key to open the door body.

The spare trash bags are continuously stacked and then sleeve the outer side of the support frame so that the trash bag can be stored into the trash can; and the trash bag in use is located at the inner side of the support frame and can prevent the trashes from polluting the support frame. The support frame is located in the upper-section can body, and the spare trash bag is continuously stacked and then sleeves the outer side of the support frame, so that the spare trash bag is not polluted after the trash bag is damaged; the support frame keeps the opening part of the trash bag open, the trash bag seals the bottom part of the trash bag in a knotting manner, and the long tubular trash bag is pulled out from the through hole in the support frame when the trash bag is pulled, so that the operation of replacing the trash bag is very convenient. The lower-section can body is provided with the door body which can be opened in a rotating manner, and the cutter for cutting the trash bag is arranged at the inner side of the door body so that the door body can be opened when the trash bag is full of trashes. The elongate tubular trash bag can be cut off by the cutter, and the trashes can be conveniently taken out. The bottom part of the justly pulled trash bag is knotted. The operation of replacing the trash bag is very simple and convenient.

The invention is not limited by the embodiments described above which are presented as examples only but can be modified in various ways within the scope of protection defined by the appended patent claims.

What is claimed is:

1. A trash can comprising a can body which comprises an upper-section can body and a lower-section can body, a trash bag being in use and arranged in the can body, wherein the can body comprises an upper part, a trash inlet formed in the upper part of the can body, an upper cover for sealing or opening the trash inlet, a support frame being arranged in the can body and comprising a through hole, and spare trash bags being continuously stacked and then sleeving the outer side of the support frame, wherein:

the trash bag in use and each of the spare trash bags is an elongate tubular trash bag, the trash bag in use passes through the through hole in the support frame and is arranged at the inner side of the support frame, the support frame keeps an opening part of the trash bag open, when the trash bag in use is pulled, the elongate tubular trash bag is pulled out from the through hole in the support frame, the support frame is located in the upper-section can body, the lower-section can body is provided with a door body which can be opened in a rotating manner, and a cutter for cutting the trash bag is arranged at the inner side of the door body, wherein the upper-section can body comprises an opening part, wherein the opening part of the upper-section can body is provided with a locating snap ring which comprises a locating and clamping block, and a locating hole matched with the locating and clamping block is formed in the upper-section can body.

2. The trash can according to the claim 1 wherein a pedal is arranged in the trash can for driving the upper cover to open or close through a connecting rod.

3. The trash can according to the claim 1, wherein an outward folded edge is arranged at the lower part of the support frame.

4. The trash can according to the claim 1, wherein an elastic cushion ring which is matched with the lower part of the support frame is arranged in the trash can.

5. The trash can according to the claim 1, wherein an inner cover is arranged in the locating snap ring; and an inner cover spring compels the inner cover to seal the trash inlet.

6. The trash can according to the claim 5, wherein a locking knob for locking the inner cover is arranged in the locating snap ring.

7. The trash can according to the claim 1, wherein the trash can is provided with a base, and the lower-section can body is fixed on the base.

8. The trash can according to the claim 7, wherein the door body comprises a side wall, wherein the lower-section can body comprises a side surface, wherein upper and lower shafts of the door body are located on the lower part of the upper-section can body and the base respectively, and a locking mechanism matched with the side wall of the door body is arranged on the side surface of the lower-section can body.

9. A trash can comprising a can body which comprises an upper-section can body and a lower-section can body, a trash bag being in use and arranged in the can body, wherein the can body comprises an upper part, a trash inlet formed in the upper part of the can body, an upper cover for sealing or opening the trash inlet, a support frame being arranged in the can body and comprising a through hole, and spare trash bags being continuously stacked and then sleeving the outer side of the support frame, wherein:

each of the trash bag in use and spare trash bags is an elongate tubular trash bag, the trash bag in use passes through the through hole in the support frame and is arranged at the inner side of the support frame, the support frame keeps an opening part of the trash bag open, when the trash bag in use is pulled, the elongate tubular trash bag is pulled out from the through hole in the support frame, the support frame is located in the upper-section can body, the lower-section can body is provided with a door body which can be opened in a rotating manner, and a cutter for cutting the trash bag is arranged at the inner side of the door body, wherein the trash can is provided with a base, and the lower-section can body is fixed on the base, wherein the door body comprises a side wall, wherein the lower-section can body comprises a side surface, wherein upper and lower shafts of the door body are located on the lower part of the upper-section can body and the base respectively, and a locking mechanism matched with the side wall of the door body is arranged on the side surface of the lower-section can body, wherein the locking mechanism comprises clamping holes and clamping hooks, wherein the clamping holes are formed in the side wall of the door body; the clamping hooks are arranged on the side surface of the lower-section can body; a pressing slope is arranged at the front end of each clamping hook; when the pressing slope at the front end of each clamping hook is in contact with the corresponding clamping hole, the clamping hook moves and enters the corresponding clamping hole; each clamping hook is provided with a key which is exposed outside the outer surface of the lower-section can body; and each clamping hook can move and exit from the corresponding clamping hole by pressing the corresponding key to open the door body.

10. The trash can according to the claim 9 wherein a pedal is arranged in the trash can for driving the upper cover to open or close through a connecting rod.

11. The trash can according to the claim 9, wherein an outward folded edge is arranged at the lower part of the support frame.

12. The trash can according to the claim 9, wherein an elastic cushion ring which is matched with the lower part of the support frame is arranged in the trash can.

13. The trash can according to the claim 9, wherein the upper-section can body comprises an opening part, wherein the opening part of the upper-section can body is provided with a locating snap ring which comprises a locating and clamping block, and a locating hole matched with the locating and clamping block is formed in the upper-section can body.

14. The trash can according to the claim 13, wherein an inner cover is arranged in the locating snap ring; and an inner cover spring compels the inner cover to seal the trash inlet.

15. The trash can according to the claim 14, wherein a locking knob for locking the inner cover is arranged in the locating snap ring.

* * * * *